US006695601B2

(12) United States Patent
Coffey

(10) Patent No.: US 6,695,601 B2
(45) Date of Patent: Feb. 24, 2004

(54) SELF-BALANCED COMPRESSOR CRANKSHAFT

(75) Inventor: Donald L. Coffey, Ann Arbor, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/164,864

(22) Filed: Jun. 7, 2002

(65) Prior Publication Data

US 2003/0228236 A1 Dec. 11, 2003

(51) Int. Cl.[7] ..... F03C 2/00

(52) U.S. Cl. ..... 418/63; 418/151; 418/55.1; 74/603; 417/902

(58) Field of Search ..... 74/603; 418/63, 418/151, 55.1; 417/902, 410.3

(56) References Cited

U.S. PATENT DOCUMENTS

| | | | | |
|---|---|---|---|---|
| 2,524,207 A | | 10/1950 | Palmer | |
| 3,513,721 A | | 5/1970 | Valbjorn et al. | |
| 4,278,409 A | * | 7/1981 | Eiermann | 418/151 |
| 4,431,356 A | * | 2/1984 | Lassota | 418/151 |
| 4,522,574 A | | 6/1985 | Arai et al. | |
| 4,611,503 A | | 9/1986 | Kocher | |
| 4,779,316 A | | 10/1988 | Cherry et al. | |
| 4,867,007 A | | 9/1989 | Krotky | |
| 5,033,945 A | | 7/1991 | Kolb | |
| 5,134,900 A | | 8/1992 | Swars | |
| 5,222,885 A | | 6/1993 | Cooksey | |
| 5,230,616 A | | 7/1993 | Serizawa et al. | |
| 5,408,745 A | | 4/1995 | Tomiyama et al. | |
| 5,857,388 A | | 1/1999 | Killion et al. | |
| 5,899,120 A | | 5/1999 | Leith | |

* cited by examiner

*Primary Examiner*—Thomas Denion
*Assistant Examiner*—Theresa Trieu
(74) *Attorney, Agent, or Firm*—Baker & Daniels

(57) ABSTRACT

A hermetic compressor assembly including a compressor housing, a compression mechanism disposed in the housing, a motor disposed in the housing; and a crankshaft operatively coupling the compression mechanism and the motor and having an axis of rotation. The crankshaft includes a cylindrical eccentric and a counter eccentric lobe. The cylindrical eccentric has a central axis, defines a circular axial profile, and is located on one radial side of the axis of rotation. The counter eccentric lobe is integrally formed with the crankshaft on the opposite side of the crankshaft from the eccentric, is axially adjacent the eccentric, and is located within the circular axial profile.

19 Claims, 4 Drawing Sheets

SELF-BALANCED COMPRESSOR CRANKSHAFT

FIELD OF THE INVENTION

The present invention relates compressors, specifically compressors having crankshafts with eccentrics thereon.

DESCRIPTION OF THE RELATED ART

A crankshaft, or drive shaft, operatively couples the motor and compression mechanism of a compressor assembly.

A problem with previous crankshafts was that they were unbalanced when used unless large counterweights were added to achieve a balanced state. An example of such a previous crankshaft may be seen in FIGS. 3*a* and 3*b* in which crankshaft 10 is shown as having a cylindrical eccentric portion 12 formed with the shaft. As seen in FIG. 3*b*, centerline 18 of eccentric 12 is offset from and parallel to centerline 20. In order to achieve a center of mass near the axial center of shaft 10, weight 14, nearly equal to the weight of eccentric 12, is placed at the opposite end of shaft 10 (upper end 15 as shown) and on the same radial side of the shaft as eccentric 12. Although this did place the center of gravity nearer the center of shaft 10 end for end, the addition of weight 14 nearly doubled the shaft's eccentric weight. So, additional weight 16 was added to the radial side of crankshaft 10 opposite from eccentric 12. Weight 16 is nearly double that of eccentric 12, and balances all dynamic forces. Thus, the overall weight of crankshaft 10 was greatly increased, by approximately four times the weight of eccentric 12 alone, in order to balance crankshaft 10.

The additional weight can result in decreased efficiency of the compressor. As the compressor operates, the shaft must be rotated to operate the compression mechanism. With the additional weight, the inertia of the crankshaft increases causing the crankshaft to become more difficult to rotate and the load on the motor to increase. This increase in loading on the motor may lead to motor failure, resulting in downtime for the compressor and potentially expensive repairs.

Previous attempts at reducing the rotating inertia of a compressor have included drilling bores in a crank journal to reduce weight (U.S. Pat. No. 3,513,721), using perforated disks as part of a counter balance unit (U.S. Pat. No. 3,876,344), using variously shaped counterweights (U.S. Pat. Nos. 4,867,007 and 4,611,503), or using dual counterweights located on the eccentric (U.S. Pat. No. 5,033,945).

Not only is the weight itself a problem, but more space is required inside the compressor to accommodate the weights. For example, the weights added to the shaft may require that height be added to the compressor to accommodate the weights. Also, each additional weight adds to the expense of the compressor.

A compressor assembly which includes a crankshaft having a reduced weight for improved efficiency, reduction in housing space, and a less expensive compressor would be desirable.

SUMMARY OF THE INVENTION

The above-described shortcomings of previous compressors are overcome by providing a hermetic compressor assembly including a compressor housing, a compression mechanism disposed in the housing, a motor disposed in the housing, and a crankshaft operatively coupling the compression mechanism and the motor. The crankshaft has an axis of rotation and includes a cylindrical eccentric having a central axis located on one side of the axis of rotation and a counter eccentric lobe integrally formed with the crankshaft on the opposite side of the crankshaft from the eccentric and being axially adjacent the eccentric.

The present invention provides a hermetic compressor assembly including a compressor housing, a compression mechanism disposed in the housing, a motor disposed in the housing; and a crankshaft operatively coupling the compression mechanism and the motor and having an axis of rotation. The crankshaft includes a cylindrical eccentric and a counter eccentric lobe. The cylindrical eccentric has a central axis, defines a circular axial profile, and is located on one radial side of the axis of rotation. The counter eccentric lobe is integrally formed with the crankshaft on the opposite side of the crankshaft from the eccentric, is axially adjacent the eccentric, and is located within the circular axial profile.

In one embodiment of the present invention, the hermetic compressor is a rotary compressor assembly and the compression mechanism includes a cylinder block and bearing assembly in the housing. The cylinder block and bearing assembly define a cylindrical cavity and a roller piston is disposed in the cavity and operative coupled to the eccentric. An example of such an embodiment is illustrated in FIG. 1 which includes cylinder block 80, bearing assembly 82, cylindrical cavity 84 and roller piston 86.

The present invention further provides a hermetic compressor assembly including a compressor housing, a compression mechanism disposed in the housing, a motor disposed in the housing, and a crankshaft operatively coupling the compression mechanism and the motor and having an axis of rotation. The crankshaft includes an eccentric portion and means for balancing the crankshaft. The eccentric portion has a cylindrical surface and a central axis on one radial side of the axis of rotation, and further defines a circular axial profile. The means for balancing the crankshaft is integrally formed with the crankshaft opposite the eccentric portion and is contained within the circular axial profile.

The present invention further provides a crankshaft for a hermetic compressor assembly and having an axis of rotation, including a cylindrical eccentric portion and a counter eccentric lobe. The eccentric portion has a central axis, is located on one radial side of the axis of rotation, and defines a circular axial profile. The counter eccentric lobe is integrally formed with the crankshaft on the radial side of the crankshaft opposite the eccentric portion, is located axially adjacent the eccentric portion, and is located within the circular axial profile.

BRIEF DESCRIPTION OF THE DRAWINGS

The above mentioned and other features and objects of this invention will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention and such exemplification is not to be construed as limiting the scope of the invention in any manner.

DETAILED DESCRIPTION

Figure 1:
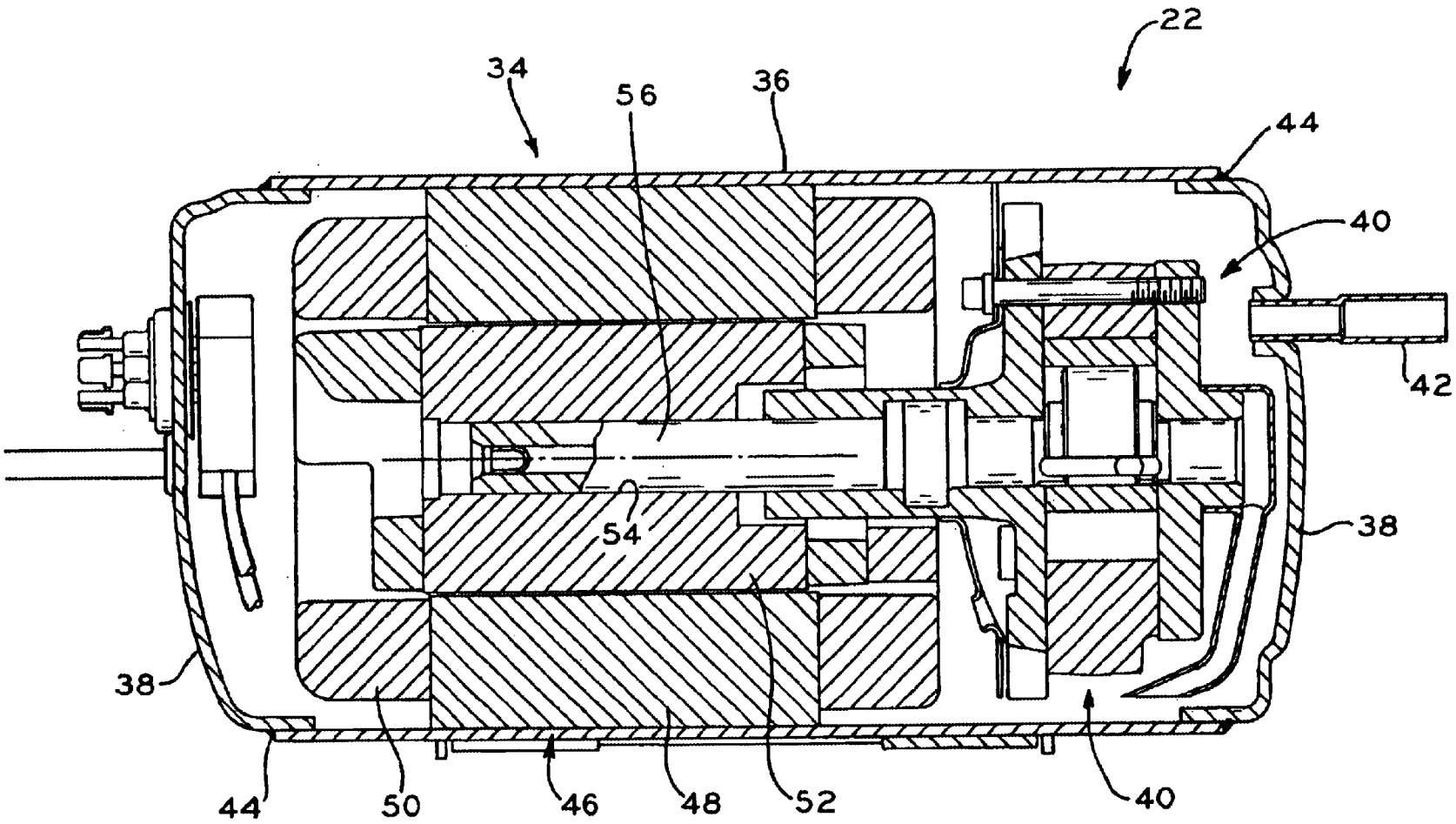
FIG. 1 is a longitudinal sectional view of a horizontal rotary compressor incorporating the inventive crankshaft.

For the purposes of promoting an understanding of the principles of the invention, reference will now be made to the embodiment illustrated in the drawings and specific language will be used to describe the same. It will nevertheless be understood that no limitation of the scope of the invention is thereby intended.

Referring to FIG. 1, rotary compressor assembly 22 is shown as an example of a type of hermetic compressor assembly in which the present invention may be advantageously used. Alternatively, the inventive crankshaft may be used in a reciprocating compressor assembly or a scroll compressor assembly. The general structure and operation of a rotary compressor assembly is disclosed in U.S. Pat. No. 5,222,885, the complete disclosure of which is hereby expressly incorporated herein by reference. The general structure and operation of a reciprocating compressor assembly is disclosed in U.S. Pat. No. 5,266,016, the complete disclosure of which is hereby expressly incorporated herein by reference. The general structure and operation of a scroll compressor assembly is disclosed in U.S. Pat. No. 5,306,126, the complete disclosure of which is hereby expressly incorporated herein by reference. Each of these patents is assigned to Tecumseh Products Company.

Housing 34 of rotary compressor assembly 22 includes main housing portion 36 and two end portions 38. Rotary compressor assembly 22 is of the high side type, and in operation, refrigerant gas is drawn from outside its housing 34 directly into its compression mechanism 40 via a suction tube (not shown). Within compression mechanism 40, the gas is compressed to a higher, discharge pressure, and then discharged from the compression mechanism into its housing 34 substantially at discharge pressure. Thereafter, the compressed gas is exhausted from the housing through discharge tube 42 and recirculated through the working refrigerant system.

The housing portions 36 and 38 for compressor assembly 22 are hermetically sealed at 44 by a method such as welding, brazing or the like. Hermetic compressor assembly 22 also includes electric motor 46 disposed within housing 34. Motor 46 comprises stator 48 provided with windings 50, and rotor 52, which is surrounded by stator 48. Rotor 52 has central aperture 54 in which inventive drive shaft or crankshaft 56 may be secured by an interference fit.

Figure 2B:
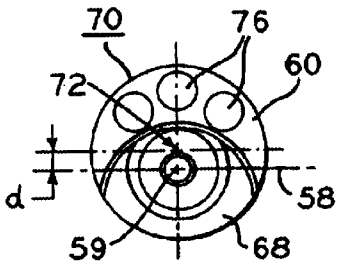
FIG. 2*b* is a sectional view of the crankshaft of FIG. 2*a* along line 2*b*—2*b;*
Figure 2A:
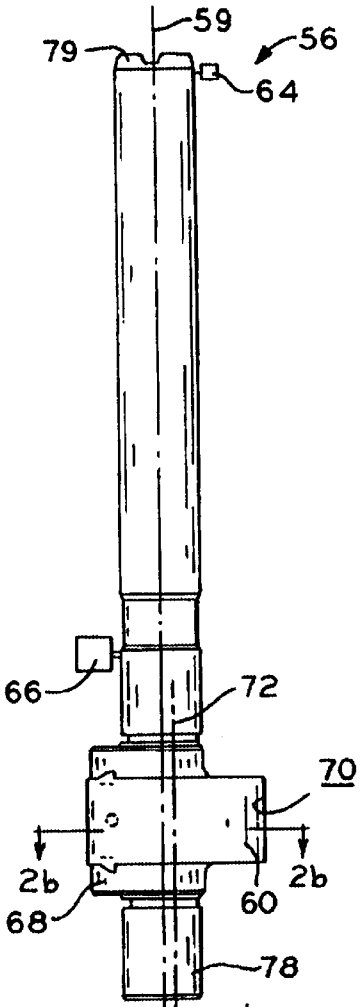
FIG. 2*a* is a longitudinal sectional schematic view of the inventive compressor crankshaft.
Figure 3B:
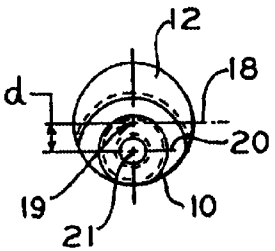
FIG. 3b (PRIOR ART)
FIG. 3*b* is a sectional view of the crankshaft of FIG. 3*a* along line 3*b*—3*b*.
Figure 3A:
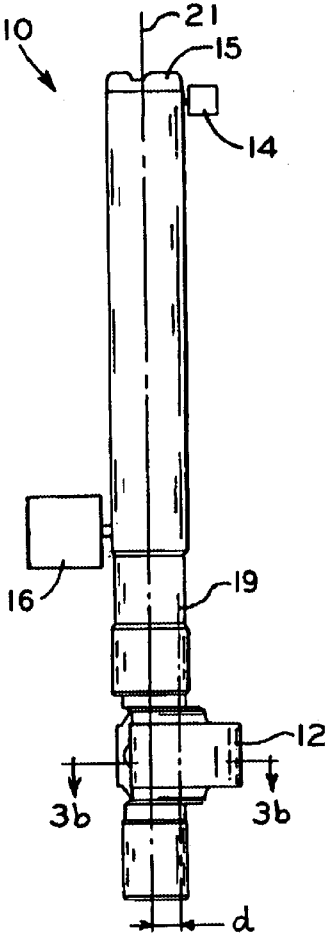
FIG. 3a (PRIOR ART)
FIG. 3*a* is a longitudinal sectional schematic view of a prior art compressor crankshaft.

Referring now to FIGS. 2*a* and 2*b*, inventive crankshaft or drive shaft 56 is shown. Except as described hereinbelow, crankshaft 56 is similar in structure to prior art crankshaft 10 of FIGS. 3*a* and 3*b* by having centerline 58 and eccentric 60 integrally formed with crankshaft 56. Inventive crankshaft 56 may include counterweight 64 at an end thereof opposite eccentric 60 and on the same radial side of crankshaft 56 and counterweight 66 located near the axial center of crankshaft 56 and on the radial side of crankshaft 56 opposite eccentric 60. Weights 64 and 66 are substantially lighter than weights 14 and 16 of previous crankshaft 10 (FIG. 3*a*). However, inventive crankshaft 56 includes counter eccentric lobe 68 integrally formed with crankshaft 56 and located on the radial side of shaft 56 opposite eccentric 60.

Eccentric 60 includes cylindrical surface 70 which defines a circular profile about eccentric central axis 72, and crankshaft 56 includes crankshaft axis, or axis of rotation, 59. The distance between eccentric central axis 72 and crankshaft axis 59 is defined as distance 'd' which is the same as distance 'd' between prior eccentric central axis 19 and prior crankshaft axis of rotation 21. Eccentric 60 of inventive crankshaft 56 may include a plurality of holes, or bores, 76 drilled therein to reduce the weight of eccentric 60, as shown in FIG. 2*b*.

Counter eccentric lobe 68 is formed axially adjacent eccentric 60 on the radial side of centerline 58 opposite axis 72, as shown in FIG. 2*b*; however, counter eccentric lobe 68 may include large portions on both the radial side of centerline 58 opposite axis 72 and the radial side of centerline 58 adjacent axis 72. As shown in FIG. 2*b*, counter eccentric lobe 68 is contained within the circular profile of eccentric 60. Placing counter eccentric lobe 68 on the radial side of crankshaft 56 opposite eccentric 60 allows counter eccentric lobe 68 to help balance the dynamic forces generated by the weight of eccentric 60. This in turn allows for a reduction in the size and weight of counterweight 66, thereby reducing the overall weight near eccentric 60 of crankshaft 56. Consequently, the reduction in weight near eccentric 60 also allows for a reduction in the size and weight of counterweight 64 located at end 79 of crankshaft 56, opposite crankshaft end 78.

Crankshaft 56 operates in a conventional manner by operatively coupling motor 46 with compression mechanism 40 during operation of compressor 22. However, with the reduced weight and inertia of crankshaft 56, motor 46 experiences less electrical loading, thereby reducing the wear on motor 46 and allowing for a longer motor life. Furthermore, the efficiency of compressor 22 is improved since motor 46 is required to do less work to rotate crankshaft 56 to operate compression mechanism 40. Additionally, the size of compressor 22 is reduced by using inventive crankshaft 56 since space within compressor housing 34, which was originally allocated for the counterweights, may be reduced due to the reduced size and weight of counterweights 64 and 66. However, the length of the compressor may not be reduced as crankshaft 56 is approximately the same length as prior art crankshaft 10.

Figure 4:
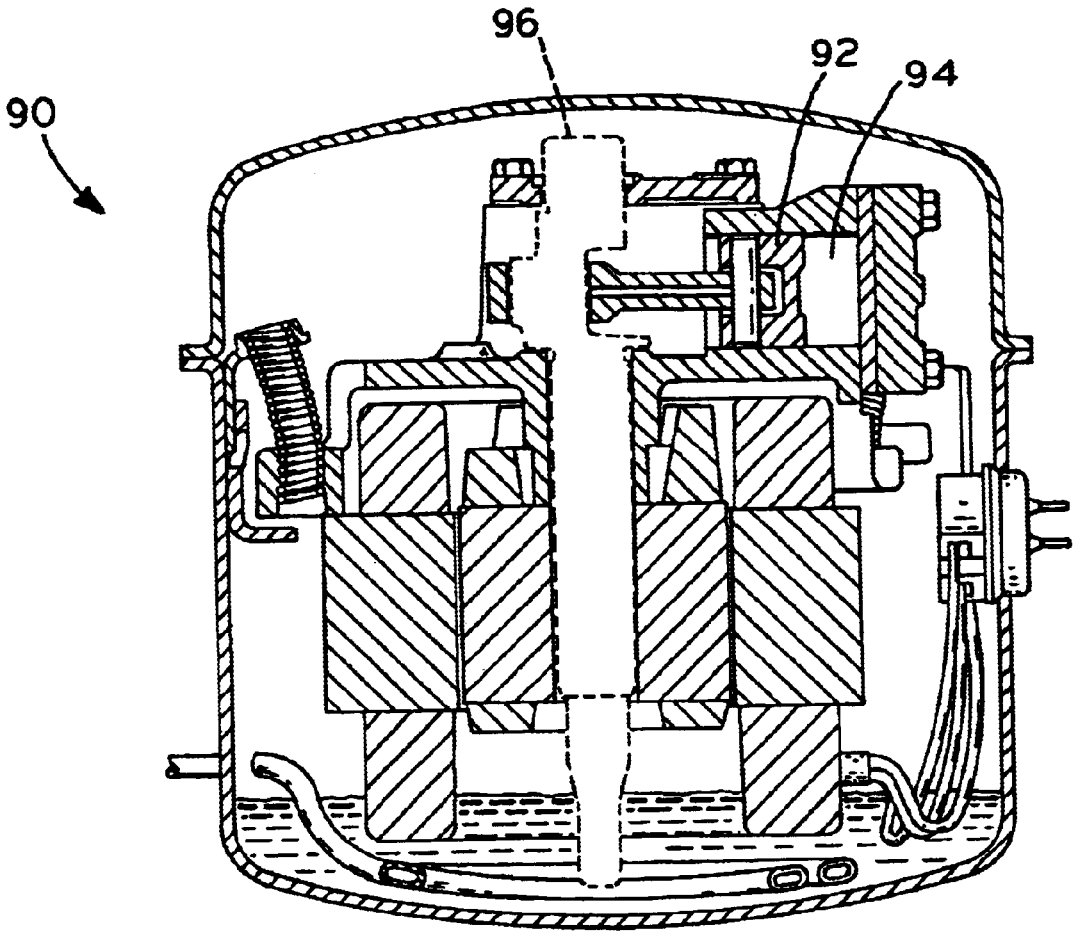
FIG. 4 is a sectional view of a reciprocating compressor assembly.
Figure 5:
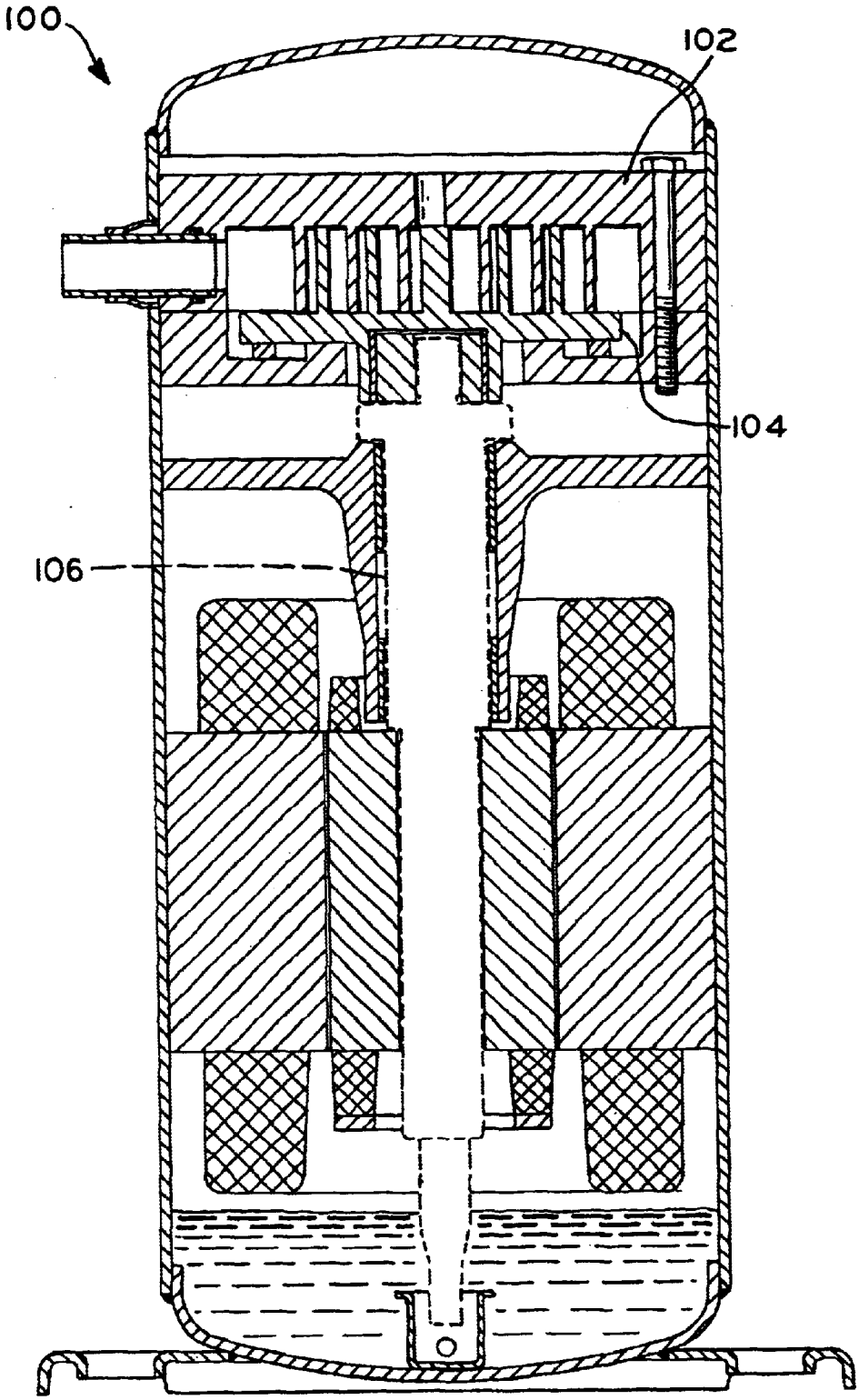
FIG. 5 is a sectional view of a scroll compressor assembly.

A reciprocating compressor assembly 90 is shown in FIG. 4 and includes a piston 92 and cylinder 94. The general location of the shaft is designated by dashed lines 96. A scroll compressor assembly 100 is shown in FIG. 5 and includes a fixed scroll member 102 and an orbiting scroll member 104. The general location of the shaft is designated by dashed lines 106.

While this invention has been described as having an exemplary structure, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetic compressor assembly comprising:

a compressor housing;

a compression mechanism disposed in said housing;

a motor disposed in said housing; and a crankshaft operatively coupling said compression mechanism and said motor, said crankshaft having an axis of rotation and comprising:

a cylindrical eccentric having a central axis and defining a circular axial profile, said eccentric central axis located on one radial side of said axis of rotation; and a counter eccentric lobe integrally formed with said crankshaft and projecting radially outwardly from the opposite side of said crankshaft from said eccentric central axis, said counter eccentric lobe being axially adjacent said eccentric and located within said circular axial profile.

2. The hermetic compressor assembly of claim 1, wherein said hermetic compressor assembly is a rotary compressor assembly and said compression mechanism includes a cylinder block and bearing assembly in said housing, said cylinder block and bearing assembly defining a cylindrical cavity, a roller piston disposed in said cavity and operatively coupled to said eccentric.

3. The hermetic compressor assembly of claim 1, wherein said hermetic compressor assembly is a reciprocating compressor assembly and said compression mechanism includes at least one cylinder and a reciprocable piston disposed in said cylinder, said piston operatively connected to said eccentric.

4. The hermetic compressor assembly of claim 1, wherein said hermetic compressor assembly is a scroll compressor assembly and said compression mechanism includes a fixed scroll member and an orbiting scroll member interleaved therewith, a compression chamber defined therebetween, said orbiting scroll member operatively coupled to said eccentric.

5. The hermetic compressor assembly of claim 1, wherein said counter eccentric lobe further includes a portion integrally formed with said crankshaft on the side of said crankshaft adjacent said eccentric.

6. A hermetic compressor assembly comprising:

a compressor housing;

a compression mechanism disposed in said housing;

a motor disposed in said housing; and a crankshaft operatively coupling said compression mechanism and said motor, said crankshaft having an axis of rotation and comprising:

a cylindrical eccentric having a central axis and defining a circular axial profile, said eccentric central axis located on one radial side of said axis of rotation, wherein said cylindrical eccentric further comprises a plurality of bores therein, whereby the weight of said crankshaft is reduced; and a counter eccentric lobe integrally formed with said crankshaft on the opposite side of said crankshaft from said eccentric central axis, said counter eccentric lobe being axially adjacent said eccentric and located within said circular axial profile.

7. A hermetic compressor assembly comprising:

a compressor housing;

a compression mechanism disposed in said housing;

a motor disposed in said housing; and a crankshaft operatively coupling said compression mechanism and said motor, said crankshaft having an axis of rotation and comprising:

an eccentric portion having a cylindrical surface and a central axis on one radial side of said axis of rotation, said eccentric portion defining a circular axial profile; and means for balancing the crankshaft integrally formed with said crankshaft and projecting radially outwardly opposite said central axis and contained within said circular axial profile.

8. The hermetic compressor assembly of claim 7, wherein said hermetic compressor assembly is a rotary compressor assembly and said compression mechanism includes a cylinder block and bearing assembly in said housing, said cylinder block and bearing assembly defining a cylindrical cavity, a roller piston disposed in said cavity and operatively coupled to said eccentric portion.

9. The hermetic compressor assembly of claim 7, wherein said hermetic compressor assembly is a reciprocating compressor assembly and said compression mechanism includes at least one cylinder and a reciprocable piston disposed in said cylinder, said piston operatively connected to said eccentric portion.

10. The hermetic compressor assembly of claim 7, wherein said hermetic compressor assembly is a scroll compressor assembly and said compression mechanism includes a fixed scroll member and an orbiting scroll member interleaved therewith, a compression chamber defined therebetween, said orbiting scroll member operatively coupled to said eccentric portion.

11. The hermetic compressor assembly of claim 7, wherein said means for balancing is located on the radial side of said axis of rotation opposite said eccentric portion central axis.

12. The hermetic compressor assembly of claim 11, wherein said means for balancing is axially adjacent said eccentric portion.

13. The hermetic compressor assembly of claim 7, wherein said means for balancing includes a counter eccentric lobe portion integrally formed with said crankshaft.

14. The hermetic compressor assembly of claim 13, wherein said counter eccentric lobe portion includes a portion integrally formed with said crankshaft on the side of said crank shaft adjacent said eccentric portion.

15. The hermetic compressor assembly of claim 14, wherein said counter eccentric lobe portion is located on the radial side of said axis of rotation opposite said eccentric portion central axis and is axially adjacent said eccentric portion.

16. A hermetic compressor assembly comprising:

a compressor housing;

a compression mechanism disposed in said housing;

a motor disposed in said housing; and a crankshaft operatively coupling said compression mechanism and said motor, said crankshaft having an axis of rotation and comprising:

an eccentric portion having a cylindrical surface and a central axis on one radial side of said axis of rotation, said eccentric portion defining a circular axial profile, wherein said eccentric portion further comprises a plurality of bores therein, whereby the weight of said crankshaft is reduced; and means for balancing the crankshaft integrally formed with said crankshaft opposite said central axis and contained within said circular axial profile.

17. A crankshaft for a hermetic compressor assembly, said crankshaft having an axis of rotation, comprising:

a cylindrical eccentric portion having a central axis and located on one radial side of said axis of rotation, said eccentric portion defining a circular axial profile; and a counter eccentric lobe integrally formed with said crankshaft and projecting radially outwardly from the radial side of said crankshaft opposite said central axis, said counter eccentric lobe being located axially adjacent said eccentric portion and located within said circular axial profile.

18. The crankshaft of claim 17, wherein said counter eccentric lobe further includes a portion located on the radial side of said axis of rotation adjacent said eccentric portion.

19. A crankshaft for a hermetic compressor assembly, said crankshaft having an axis of rotation, comprising:

a cylindrical eccentric portion having a central axis and located on one radial side of said axis of rotation, said eccentric portion defining a circular axial profile, wherein said eccentric portion further includes a plurality of bores therein, whereby the weight of said crankshaft is reduced; and a counter eccentric lobe integrally formed with said crankshaft on the radial side of said crankshaft opposite said central axis, said counter eccentric lobe being located axially adjacent said eccentric portion and located within said circular axial profile.

* * * * *